US005480259A

United States Patent [19]

Thrower

[11] Patent Number: 5,480,259

[45] **Date of Patent: *Jan. 2, 1996**

[54] AGGREGATE FLOOR AND METHOD FOR FORMING SAME

[76] Inventor: John H. Thrower, 1231 Belrose La., Charlotte, N.C. 28209

[ * ] Notice: The term of this patent shall not extend beyond the expiration date of Pat. No. 5,339,589.

[21] Appl. No.: 267,406

[22] Filed: Jun. 29, 1994

[51] Int. Cl.[6] ..... E01C 19/23

[52] U.S. Cl. ..... 404/117; 404/131

[58] Field of Search ..... 404/117, 122, 404/131; 52/749

[56] References Cited

U.S. PATENT DOCUMENTS 3,814,531 6/1974 Carnahan et al. ..... 404/117
5,339,589 8/1994 Thrower ..... 52/612 X

FOREIGN PATENT DOCUMENTS 2154190 9/1985 United Kingdom ..... 404/131

*Primary Examiner*—William P. Neuder

[57] ABSTRACT

An aggregate floor including terrazzo and the like and a method for forming the floor on a supporting surface, the floor including a layer of flexible compound applied to the surface, a reinforcement mesh positioned between divider strips and adjacent the compound and supporting a layer of compacted aggregate forming a substantially level surface. The divider strips are selectively positioned in desired configurations on the flexible compound layer to divide the mesh and aggregate into discreet and crack controlled sections. A mixture of composite cement, water, and, in some cases, sand is applied to the surface of the aggregate layer in such a viscosity as to gravitate completely through the aggregate layer and make contact with the underlying layer of flexible compound. Such permeation fills and replaces the air pockets between the aggregate particles and deposits sufficient top coating on the surface of the aggregate to be polished to a finished surface. The method includes the steps of compacting the aggregate in dry form as it is applied to the mesh and thereafter compacting the aggregate together with the composite cement, water and sand, when used, to form the upper surface to be polished.

4 Claims, 1 Drawing Sheet

AGGREGATE FLOOR AND METHOD FOR FORMING SAME

BACKGROUND OF THE INVENTION

1. Field of the Invention

The present invention relates to installed floors and more particularly, to a new and improved aggregate floor and method for forming same.

2. Description of the Prior Art

Aggregate, particularly terrazzo, floors have been used for many years and have for the most part been constructed in accordance with well-established principles and methods throughout that period of time. Customarily a foundation layer of material usually composed of concrete, which may be formed in any desired thickness according to load requirements, is placed on the ground. A screed bed into which divider strips are usually imbedded is then installed over the foundation layer forming panels into which is poured a mixture of cement, water and aggregate. A screed bed is a mixture of sand, cement and water, labeled a "lean" mixture because it contains no aggregate and less water than the accepted formula for concrete, and is considered an integral part of a terrazzo installation because it brings the foundation substrate layer closer to level, absorbs horizontal movement between the building structure and the aggregate surface, and serves as a setting bed for the panel forming divider strips. The divider strips serve as a gauge as to which the floor will be leveled and provide expansion joints and control paths for cracks.

The resulting floor is quickly trowel-leveled to the top of the strips, if strips are present. After this initial leveling, plain, matching aggregate is sprinkled over the surface which is then compacted and compressed with static rollers varying in size and weight from 2 inches (2") to twenty-four inches (24") in diameter and from two (2) pounds to three hundred (300) pounds in weight. The purpose of this multiple rolling operation is to level the surface, force out any entrapped air and all excess cement, and compact the aggregate to the greatest possible density. Once the mixture cures, it is polished so that the aggregate, usually marble, contained therein becomes decorative and formal in appearance.

Certain problems are encountered in this conventional process. Cement has a limited open time within which the necessary steps must be accomplished to complete leveling and compacting the aggregate before curing begins. When the weight of a static roller is the only factor upon which compression depends, and these rollers must be utilized in multiple directions as well as varying sizes, the time-factor must be apportioned to the steps involved and becomes more critical, diminishing the size of the workable area within the available time. Restricted by the various times involved, it is necessary to pour a limited area of such a floor so that one section can be completed before a new section is started. Consequently the installation process is an involved and extended one.

Thus prior art formation of terrazzo floors is necessarily slow and labor-intensive. Continuing efforts to decrease the time needed for the installation of such floors have been made but without significant success. The present invention is directed to this end, and provides an expediency heretofore unachieved in the art.

OBJECTIVES AND SUMMARY OF THE INVENTION

The general purpose of the present invention, which will be described subsequently in greater detail, is to provide a new and improved aggregate floor and method for forming same which have all of the advantages of prior art aggregate floors and methods and none of the disadvantages.

Another objective of the present invention is to provide an aggregate floor such as a terrazzo floor of novel construction which can be substantially installed in dry form and subsequently finished in a single operation thus avoiding sectional formation as heretofore required.

Yet another objective of the present invention is to provide an aggregate floor of the type described which can be formed by utilizing a vibrating roller that expedites the leveling and compacting steps and enables a shorter installation time.

Yet still another further objective of the present invention is to provide a floor and method of the type described utilizing less costly ingredients and more compatible components than those previously utilized.

The novel floor comprising the present invention includes a supporting surface on which is positioned a layer of flexible compound. A plurality of divider strips are selectively positioned in desired configurations on the flexible compound layer. Sections of reinforcement mesh are positioned adjacent the compound and between the divider strips, if used, and a layer of loose, dry aggregate such as marble is applied to the mesh. A viscous mixture of cement, water and sand (when used) is applied to the aggregate, permeating through the spaces between the aggregate and thus moving the mixture and the aggregate through the reinforcement mesh to the layer of flexible compound.

A vibrating roller is utilized to first compact the aggregate in dry form on the reinforcement mesh and thereafter again to compact the mixture layer of the aggregate with the composite cement, water and sand (when used) to complete the formation of the floor surface.

Thus, there has been outlined, rather broadly, and in summary form, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects attained by its use, reference should be made to the accompanying drawings and descriptive matter in which like characters of reference designate like parts throughout the several views.

BRIEF DESCRIPTION OF THE DRAWINGS

The invention will be better understood and objects other than those set forth above will become apparent when consideration is given to the following detailed description which makes reference to the annexed drawings wherein.

DESCRIPTION OF THE PREFERRED EMBODIMENT

Figure 1:
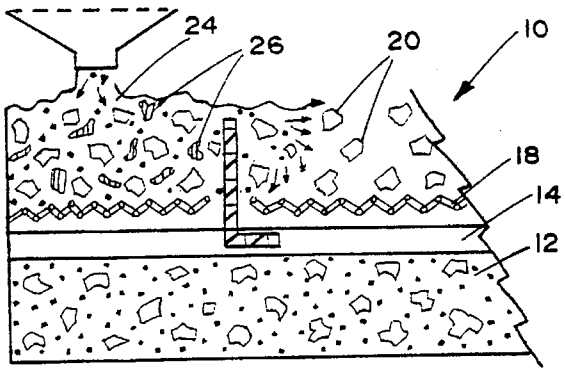
FIG. 1 is a side elevational, fragmentary and sectional view of the aggregate (in this example, terrazzo) floor comprising the present invention in an unrolled condition.
Figure 2:
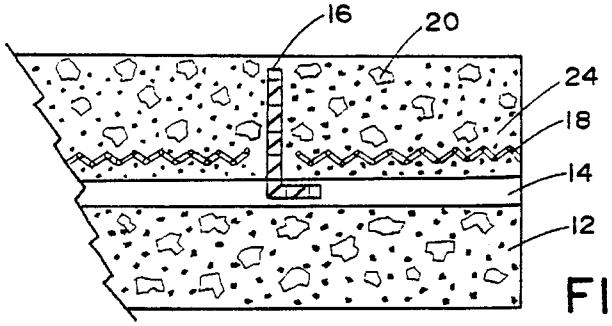
FIG. 2 is a side elevational, fragmentary and sectional view of the aggregate floor of FIG. 1 in the rolled condition.

Referring now to the drawings and particularly to FIG. 1, an unfinished form of the aggregate floor (in this example, terrazzo) comprising the present invention shown generally as 10 includes a supporting surface usually in the form of a concrete slab 12 to which is applied a layer of flexible compound, preferably an acrylic latex coating 14 to serve as a setting bed for the panel-forming divider strips 16 (when used), and to absorb horizontal movement between the building structure (concrete slab 12) and the aggregate surface. One or more divider strips 16 is usually applied at this stage to serve as a gauge for leveling the sections defined by such dividers, to provide expansion joints and to direct crack formations should they occur. These divider strips 16 are selectively positioned in predetermined configurations.

Figure 5:
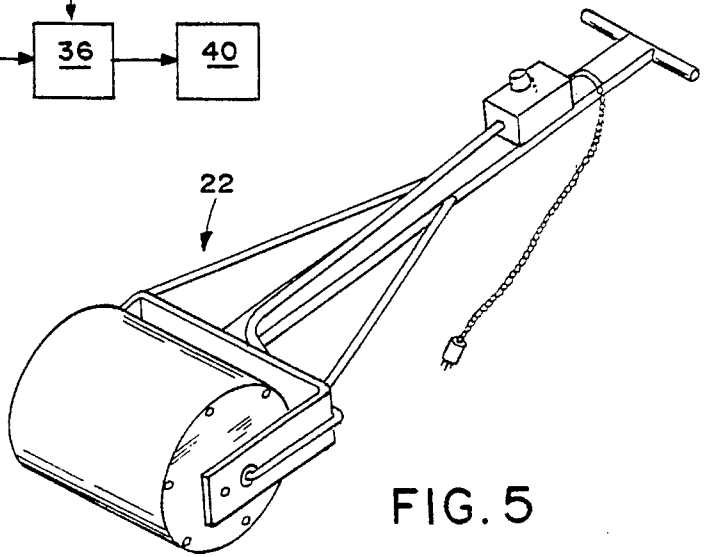
FIG. 5 is a perspective view of one form of the vibrating roller utilized to form the novel floor shown in FIGS. 1, 2 and 4 by the method comprising the present invention.

A reinforcement mesh usually of fiberglass 18 is to provide tensile strength is applied to the surface of flexible compound 14 between divider strips 16. A layer of aggregate 20 in dry form is poured on mesh 18 and is thereafter leveled initially by troweling then thereafter by the use of a vibrating roller shown generally as 22 in FIG. 5. Since the aggregate is poured in dry form, the entire floor can be poured at this step of the procedure and thereafter compacted and leveled without time constraints since there is no setting time to inhibit the operation.

The final component of the floor and the final step of the process for installing it includes the application of a mixture of composite cement, water and sand (when used) 24 forming a viscous cement solution. In this state, the entire surface of the floor comprising the aggregate 20 and the viscous cement solution 24 is compacted with roller 22 forcing out excess cement and any entrapped air pockets 26. This compacting operation for the entire floor can take place in a relatively short period of time and thus expedite significantly the normal formation time of aggregate floors, such as terrazzo, utilizing a similar construction.

Figure 3:
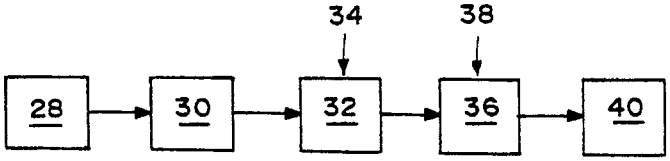
FIG. 3 is a block diagram setting forth the steps involved in the method of producing the novel floor shown in FIGS. 1, 2 and 4.
Figure 4:
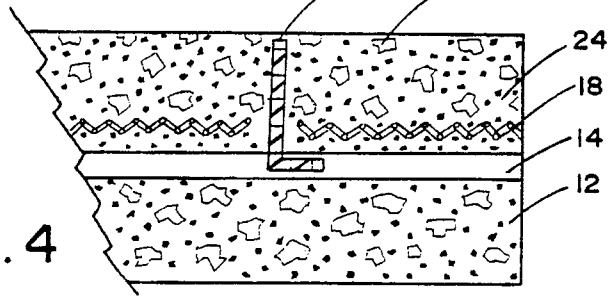
FIG. 4 is a side elevational, fragmentary and sectional view of the aggregate floor of FIGS. 1 and 2 in the polished condition.

Thus the novel method of the present invention includes the steps (see FIG. 3) involved in the method of 28 applying a layer of flexible compound to the surface, 30 applying a woven reinforcement mesh over the compound, 32 spreading an aggregate onto the mesh, 34 compacting the aggregate with a vibrating roller, 36 applying a mixture of cement and water to the aggregate bed, 38 compacting these components with a vibrating roller to firm and set the mixture into the voids of the aggregate, and 40 finishing when desirable the cement and aggregate mixture.

While any number of flexible compound layers may be utilized in the present invention, it has been found in most circumstances to be quite satisfactory to apply the compound in a thickness within the range of from one-sixteenth inch (1/16") to one-quarter inch (1/4"). The preferred substance for the flexible compound is acrylic latex.

The woven reinforcement mesh is necessarily an alkali-resistant material desirably selected from the group consisting of fiberglass or polyester.

In prior art techniques for producing terrazzo floors, static rollers varying in size and weight from two inches (2") to twenty-four inches (24") in diameter and from two (2) pounds to three hundred (300) pounds in weight are used. In the present invention, the vibrating roller preferably has a diameter within the range of from eight inches (8") to twenty-four inches (24") and weighs within the range of from twenty (20) pounds to three hundred (300) pounds. More importantly, the roller vibration rate is within the range of from two hundred (200) to five thousand (5,000) vibrations per minute and may be variable within that range, and the impact force of the roller is within the range of from ten (10) to one thousand (1,000) pounds and may be variable within that range.

Utilizing the components and steps of the present invention, it has been found that aggregate flooring such as terrazzo can be installed up to three hundred percent (300%) faster than installation by conventional techniques. The ability to complete an entire floor rather than to be limited to completing a floor section by section provides an additional significant advantage.

From this detailed description, it can be seen that an aggregate floor (particularly a terrazzo floor) and method for forming same have been provided that will meet all of the advantages of prior art floors and techniques and offer additional advantages not offered by the prior art. Optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed herein.

The foregoing is considered as illustrative only of the principles of the invention. Since numerous modifications and changes will readily occur to those skilled in the art, it is not intended to limit the invention to the exact construction and operation shown and described. All suitable modifications and equivalents that fall within the scope of the appended claims are deemed within the present inventive concept.

What is claimed is:

1. A manually movable roller for treating and forming an aggregate terrazzo or concrete floor having a frame, handle means including a tongue and a gripping member extending from the frame, and a single roller drum rotatably secured to the frame, the roller drum having a weight of between 20 and 30 pounds; vibrating means associated with the roller drum for vibrating the roller drum within the range of from 200 to 5000 vibrations per minute; and control means carried by the tongue for selectively establishing the variations per minute for the vibrating means to treat the floor whereby the roller may be pivotally turned to treat small and non-uniform floors.

2. The roller as claimed in claim 1 wherein the force created by the vibrations fall within the range of from 10 pounds to 1,000 pounds.

3. The roller as claimed in claim 1 wherein the roller drum has a diameter within the range of from 8 to 24 inches.

4. The roller as claimed in claim 2 wherein the roller drum has a diameter within the range of from 8 to 24 inches.

* * * * *